US007287838B2

(12) United States Patent
Tsuchii et al.

(10) Patent No.: US 7,287,838 B2
(45) Date of Patent: Oct. 30, 2007

(54) LIQUID DISCHARGE HEAD HAVING PROTECTIVE FILM FOR HEATING ELEMENT AND SUBSTRATE THEREFOR

(75) Inventors: Ken Tsuchii, Sagamihara (JP); Mineo Kaneko, Meguro-ku (JP); Masaki Oikawa, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 11/082,397

(22) Filed: Mar. 17, 2005

(65) Prior Publication Data

US 2005/0212861 A1 Sep. 29, 2005

(30) Foreign Application Priority Data

Mar. 24, 2004 (JP) ..... 2004-086867
Feb. 2, 2005 (JP) ..... 2005-026423

(51) Int. Cl.
*B41J 2/05* (2006.01)

(52) U.S. Cl. ..... 347/63; 347/64

(58) Field of Classification Search ..... 347/20, 347/56, 61–65, 67
See application file for complete search history.

(56) References Cited

U.S. PATENT DOCUMENTS 4,567,493 A 1/1986 Ikeda ..... 347/64
5,163,177 A * 11/1992 Komura ..... 347/64
5,946,013 A * 8/1999 Kurihara et al. ..... 347/64

FOREIGN PATENT DOCUMENTS

JP 40-5254122 A * 10/1993 ..... 347/64

* cited by examiner

*Primary Examiner*—Juanita D. Stephens
(74) *Attorney, Agent, or Firm*—Canon U.S.A. Inc. I.P. Div.

(57) ABSTRACT

A liquid discharge head substrate has improved protection performance of protective films for protecting heaters while effective bubble-forming regions are being secured. The protective films for protecting a plurality of heating elements provided on a substrate are formed using a platinum group element and are separately provided for the respective heating elements.

12 Claims, 5 Drawing Sheets

LIQUID DISCHARGE HEAD HAVING PROTECTIVE FILM FOR HEATING ELEMENT AND SUBSTRATE THEREFOR

BACKGROUND OF THE INVENTION

1. Field of the Invention

The present invention relates to an inkjet liquid discharge head for discharging liquid such as ink from discharge ports and a substrate therefor, the liquid being discharged by the steps of applying thermal energy thereto using heating elements provided in flow paths through which the liquid flows so as to cause film boiling in the liquid, and then discharging the liquid using bubbles formed by the film boiling.

2. Description of the Related Art

Hitherto, as a liquid discharge head, in particular, as an inkjet liquid discharge head, for example, the structure has been disclosed in U.S. Pat. No. 4,567,493 in which thermal energy is applied to liquid filled in ink flow paths by heaters provided therein to form bubbles for discharging ink from discharge ports communicating with the ink flow paths.

In the liquid discharge head disclosed in U.S. Pat. No. 4,567,493, a heat accumulating layer, which is a lower layer made of $SiO_2$ for preventing heat generated by a heater from being dissipated, is formed on a silicon (Si) substrate, and a heater film which is a heat generating resistive layer made of $HfB_2$ is further provided on the heat accumulating layer described above. Wires made of aluminum (Al) for supplying electricity to the heater film described above are disposed with a predetermined space interposed therebetween to form a predetermined pattern. A region between the wires disposed with a predetermined space interposed therebetween is a heat generation region which generates heat when current is supplied to the heater film. On the heater film and the wires, there are provided an insulating layer made of $SiO_2$, which is a first upper protective layer, for isolating ink from the heater film and the wires; a protective layer made of tantalum (Ta), which is a third protective layer, for protecting the heater film from impact which is generated when a bubble formed in the ink by film boiling is defoamed; and a resinous protective layer, which is a second protective layer provided in a region other than the heat generation region, for preventing the ink from permeating through the insulating film.

SUMMARY OF THE INVENTION

The present invention is directed to a liquid discharge head substrate and a liquid discharge head incorporating the liquid discharge head substrate. In one aspect of the present invention, a liquid discharge head substrate includes a substrate; a plurality of heating elements provided on the substrate; and metal protective films separately provided for the respective heating elements to protect the heating elements, wherein the metal protective films include a platinum group element.

Further features and advantages of the present invention will become apparent from the following description of exemplary embodiments with reference to the attached drawings.

BRIEF DESCRIPTION OF THE DRAWINGS

FIG. 3(*b*) is a schematic cross-sectional view of the liquid discharge head shown in FIG. 3(*a*) taken along the line A-A'.

FIG. 3(*c*) is a graph showing a temperature distribution of the liquid discharge head along the line A-A' shown in FIG. 3(*a*).

FIG. 4(*b*) is a schematic cross-sectional view of the liquid discharge head shown in FIG. 4(*a*) taken along the line E-E'.

FIG. 4(*c*) is a graph showing a temperature distribution of the liquid discharge head along the line E-E' shown in FIG. 4(*a*).

DESCRIPTION OF THE EMBODIMENTS

Figure 1:
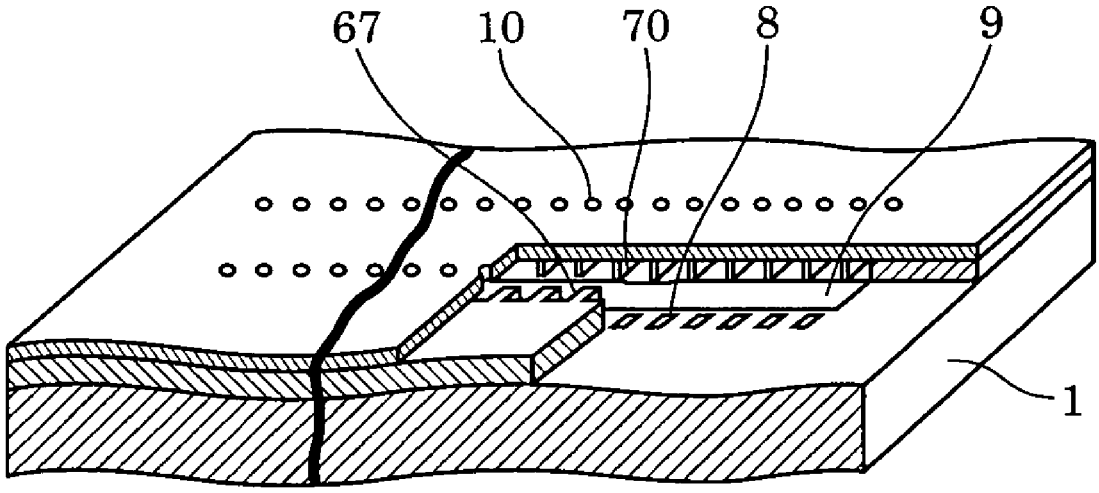
FIG. 1 is a partially exploded, schematic, perspective view of a liquid discharge head used in the present invention.

According to recent requirements of higher speed and superior image quality of printing, in a liquid discharge head, durability has become more important than in the past. As a material for forming a protective film which protects a heater film from impact generated when bubbles are defoamed, in view of the durability, a platinum group element such as Ir (iridium) or Pt (platinum), which is more chemically stable than Ta, has been considered as a candidate.

However, when a platinum group, such as Ir or Pt, was used in the structure disclosed in U.S. Pat. No. 4,567,493, a phenomenon such as blurring or color irregularities occurred. This phenomenon will be described below.

In the liquid discharge head, protective films made of Ta and wires made of aluminum, which have a high thermal conductivity, are provided at a peripheral area of a heat generation region of a heater. Hence, through the protective films and the wires, heat generated in the heat generation region of the heater diffuses. That is, in the vicinity of the peripheral area of the heat generation region, the temperature is decreased toward the periphery of the region described above as compared to that at the central portion of the heat generation region. As a result, a temperature distribution in the heat generation region has a trapezoidal shape.

When the temperature at the central portion of the heat generation region is increased to a bubble-forming temperature (approximately 300° C.), bubbles are formed in a liquid, and as a result, high pressure for discharging ink can be obtained. In this step, bubbles used for discharging ink are formed at the central portion of the heat generation region which is heated to a high temperature. However, since the temperature at the peripheral area of the heat generation region is not sufficient, bubbles used for discharging ink are not formed. That is, in the entire heat generation region, a region actually used for forming bubbles in ink is only the central portion which is heated to a high temperature. This high temperature region, that is, the region in which bubbles used for discharging ink are formed, is hereinafter referred to as an effective bubble-forming region.

Since having a high thermal conductivity as compared to that of Ta, when a platinum group element such as Ir or Pt as described above is used for forming a protective film, heat is liable to escape from the heat generation region through the periphery thereof. As a result, a ratio in size of the effective bubble-forming region to the heat generation region of the heater is considerably decreased. That is, the area of the effective bubble-forming region is extremely decreased, and it has been believed that the excessively small effective bubble-forming region described above causes blurring and color irregularities.

Accordingly, the present invention provides a liquid discharge head in which protective performance of the protective films for protecting heaters are improved while the effective bubble-forming regions are being secured.

Hereinafter, embodiments of the present invention will be described with reference to figures.

FIRST EMBODIMENT

Referring to FIGS. 1, 2A, 2B, and 2C, a liquid discharge head of a first embodiment according to the present invention will be described in detail.

FIG. 1 is a partially exploded, schematic, perspective view of the liquid discharge head of the first embodiment according to the present invention.

A liquid discharge head substrate of this embodiment comprises a silicon (Si) substrate 1 having an opening, which is a supply inlet port 9 made of a long groove-shaped penetrating hole for supplying liquid (ink), a plurality of heating elements (heaters 8), and metal protective films (not shown) separately provided for the respective heaters for protection thereof, the heating elements and the metal protective films being provided on the substrate 1. On this liquid discharge head substrate, a flow path member (nozzle wall 67) forming flow paths 70 through which liquid flows and a plate having discharge ports corresponding to the heating elements are provided to form a liquid discharge head. The heaters are disposed in a staggered manner along two sides of the ink supply port 9, the intervals of the heaters on each side being about 600 dpi. When the liquid is supplied from the supply port 9 to the flow paths 70, thermal energy is applied to the liquid by the heaters provided for the respective flow paths, and as a result, by bubbles formed in the liquid, the liquid is discharged from discharge ports 10.

Since the area of a region which is not used for bubble formation, which region is formed by diffusion of heat generated in the heat generation region of the heater through the protective film and the wire, is not significantly influenced by the size of a heater, in an inkjet head using miniaturized heaters, a problem caused by a decrease in area of the effective bubble-forming region becomes serious. In addition, since the size of a liquid droplet discharged using a miniaturized heater is small, the number of operations of the heater is increased, and as a result, the durability of the protective film for protecting the heater has been required.

In particular, the present invention is effectively applied to a head having miniaturized heaters as described above. In this embodiment, although having high thermal conductivity, a material having chemical stability is used for the protective film, which has been difficult to use in view of energy efficiency, and hence, while the bubble-forming region is being secured, the durability of the heater can be improved without decreasing the energy efficiency.

Figure 2A:
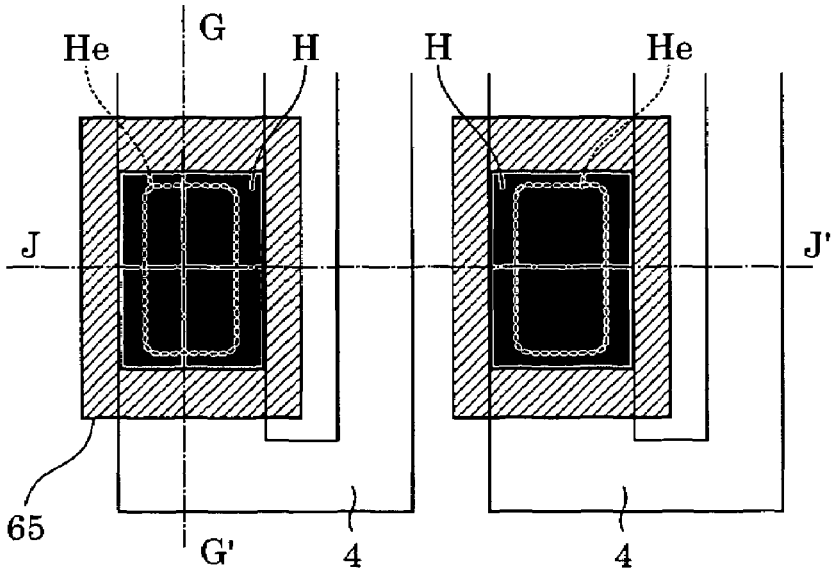
FIG. 2A is a schematic plan view showing the vicinity of a heater of a liquid discharge head according to a first embodiment of the present invention.
Figure 2B:
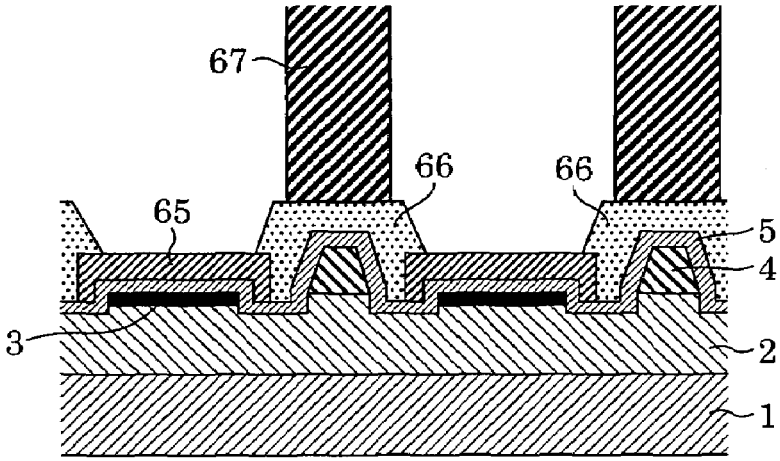
FIG. 2B is a schematic cross-sectional view of the liquid discharge head shown in FIG. 2A taken along the line J-J'.
Figure 2C:
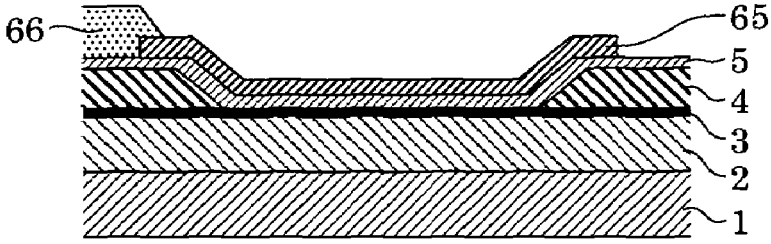
FIG. 2C is a schematic cross-sectional view of the liquid discharge head shown in FIG. 2A taken along the line G-G'.

FIG. 2A is a schematic plan view showing the vicinity of the heater of the head shown in FIG. 1, FIG. 2B is a partially schematic cross-sectional view of the head perpendicular to the substrate along the line J-J' shown in FIG. 2A, and FIG. 2C is a partially schematic cross-sectional view of the head perpendicular to the substrate along line G-G' shown in FIG. 2A. In FIG. 2A, a pattern of a wire 4 is shown through an insulating film 5.

In FIG. 2B, a heat accumulating layer 2 made of $SiO_2$, which serves to prevent heat generated by the heater from being dissipated, is formed on the Si substrate 1, and on this heat accumulating layer 2, heater films 3 made of TaSiN are formed, each of which generates heat when electricity is supplied thereto. On the heater films 3, aluminum wires 4 having a predetermined pattern are formed for supplying electricity, and the wires 4 and the respective heater films 3 form the heaters 8. The wires 4 are provided at predetermined regular intervals, and regions of the heater films located at spaces between the wires 4 described above each form a heat generation region H when electricity is supplied thereto. On the heater films 3 and the wires 4, an insulating film 5 made of SiO or SiN is formed which serves to insulate the heaters 3 and the wires 4 from ink. On this insulating film 5, metal protective films 65 are formed, each functioning to protect the heater film 3 from impact applied thereto when a bubble generated in ink by the film boiling is defoamed. As a material for this metal protective film 65, a platinum group element may be used, and in this embodiment, Ir is used. In this embodiment, the size of the heater is about 26 μm by 26 μm, and the metal protective film 65 is formed to have a size of about 27 μm by 27 μm. The metal protective film is formed to cover the heat generation region of the heater so that the periphery of the metal protective film is disposed outside the heat generation region of the heater at a distance of about 0.5 μm apart from the periphery thereof. In addition, the metal protective films are separately formed for the respective heaters.

In FIG. 2A, in the heat generation region H on the heater, the effective bubble-forming region is indicated by He which is a high temperature region substantially used for forming bubbles in ink. Although the thermal conductivity of Ir is 147 (W/m·K) and is significantly high as compared to the thermal conductivity of Ta, which is 57.5 (W/m·K), since the protective film 65 is thermally isolated from the surrounding components in this embodiment, the diffusion of heat to the adjacent heat generation region through the protective film can be suppressed. As a result, in the structure of this embodiment, even when a platinum group element such as Ir having a high thermal conductivity is used, the area of a picture-frame region (region obtained by eliminating the effective bubble-forming region He from the heat generation region H) which is not used for forming bubbles can be prevented from being extremely increased, and the area of the effective heat generation region can be maintained substantially equivalent to that heretofore obtained when tantalum (Ta) is used as the protective film.

As is the case of this embodiment, when a heater having a size of about 26 μm by 26 μm is used, and a protective film is used which covers the heater so that the periphery of the protective film is located outside the periphery of the heater at a distance of about 0.5 μm apart therefrom, the effective bubble-forming region He is to be located inside the heat generation region H at a distance of about 4 μm apart from the periphery thereof. That is, the area of the effective bubble-forming region He is about 324 $\mu m^2$ and is substantially equivalent to that obtained when a Ta protective film is continuously formed to the heat generation region adjacent thereto.

Accordingly, in order to secure an effective bubble-forming region equal to or more than that heretofore obtained, the protective film may be formed so that the periphery thereof is located outside the periphery of the heater at a distance of about 0.5 μm or less apart therefrom. By using a metal protective film having the size as described above, even when a platinum group element such as Ir having a thermal conductivity higher than that of Ta is used, ink can be heated so as to form bubbles without decreasing bubble-forming efficiency. In addition, due to the chemical stability of a platinum group element such as Ir, the durability as the protective film is improved, and the durability of the heater is also improved.

In this embodiment, as shown in FIG. 2B, an adhesion layer (nozzle adhesion layer 66) adhering the liquid discharge head substrate to the nozzle wall is provided therebetween and is also provided between the adjacent metal protective films 65. By the structure described above, since the insulating film 5 and the protective film 65, each of which has an concave-convex shape, are planarized using the adhesion layer, the adhesion between the nozzle wall 67 and the liquid discharge head substrate is improved with the adhesion layer provided therebetween.

In addition, as a resinous heat insulating material such as a poly(ether amide) based resin, for example, when an organic resin such as HIMAL (trade name by Hitachi Chemical Co., Ltd.) is used for the nozzle adhesion layer 66, an effect of suppressing the diffusion of heat from the protective film 65 can be obtained. Furthermore, as shown in FIG. 2B, since parts of the adhesion layer 66 are formed so as to cover the end portions of the protective films 65 which are separately provided, the diffusion of heat toward the periphery of the heat generation region H is further suppressed, and as a result, a decrease in area of the effective bubble-forming region can be suppressed.

As described above, by using the adhesion layer having the structure as described above, the diffusion of heat can be further suppressed, ink can be further efficiently heated to form bubbles, and the adhesion of the nozzle wall can be sufficiently ensured, thereby forming a highly reliable liquid discharge head.

In FIGS. 2A to 2C, the case in which three sides of the protective film are surrounded by the adhesion layer is shown, and of course, four sides of the protective film may be surrounded by the adhesion layer.

In the embodiment described above, the case in which Ir is used as the metal protective film is shown by way of example; however, the present invention is not limited thereto, and when a platinum group element such as Pt is used, the same effect as described above can also be obtained.

As has thus been described, according to this embodiment, while the effective bubble-forming region that has been heretofore obtained is being secured for the heater of the liquid discharge head, superior durability can be obtained.

FIRST COMPARATIVE EXAMPLE

As a first comparative example, the case will be described in which a heater having a size of about 26 μm×26 μm is used as is the first embodiment and in which an Ir protective film is continuously formed to an adjacent heat generation portion as the Ta protective film which has been heretofore used.

The effective bubble-forming region He of this comparative example was a region (having an effective bubble-forming area of 196 $\mu m^2$) located inside the heat generation region H at a distance of approximately 6 μm apart from the periphery thereof. On the other hand, in the structure of the first embodiment, when the heater size was 26 μm×26 μm, the effective bubble-forming region was a region located inside the heat generation region at a distance of approximately 4 μm apart from the periphery thereof, and the area of the effective bubble-forming region was 324 $\mu m^2$. It is understood that, since a bubble-forming power is generally proportional to the effective bubble-forming region He, when the Ta protective film described above is simply replaced with the Ir protective film, the bubble-forming power is decreased by 40% as compared to that obtained in the first embodiment of the present invention.

SECOND COMPARATIVE EXAMPLE

As a second comparative example, the case will be described in which Ir is used as the protective film, and the heater size itself is increased to 30 μm×30 μm so that the effective bubble-forming region He becomes equivalent to that obtained in the first embodiment. The head having the structure according to the first embodiment and the head of the second comparative example were driven, and the properties thereof were compared to each other.

By the two heads described above, when printing was continuously performed using two ink colors on a sheet of A4 size paper to fill the paper with letters, although apparent contrast irregularity of images was not observed by using the head of the first embodiment, by the head of the second comparative example, degradation in image quality was observed which was caused by contrast irregularity of images.

In general, in a liquid discharge head, when the head thereof is excessively heated, ink may not be discharged and/or the head may malfunction in some cases. Hence, a sequence control program (hereinafter referred to as "detection of temperature increment") is installed which temporarily stops printing when the temperature of the head is increased to a predetermined temperature (such as 50-55° C.) or more. In the case of the second comparative example, the detection of temperature increment frequently operated and interrupted printing, and as a result, a large decrease in throughput was observed as compared to that obtained in the first embodiment. The reason for this is believed that since the size of the heater is increased, the total heat quantity is increased.

As described above, according to the structure of the present invention, even when a platinum group element such as Ir is used for the protective film, the diffusion of heat can be suppressed, and without changing the heater size, an effective bubble-forming region equivalent to that heretofore obtained can be secured. As a result, while a high throughput is being maintained, improvement in durability can be realized.

SECOND EMBODIMENT

In a second embodiment, the case will be described in which the protective film is formed in a region having a size equal to or less than that of the heat generation region H corresponding to the size of the heater, and description of the same constituent elements and structures as those in the first embodiment will be omitted.

Figure 3:
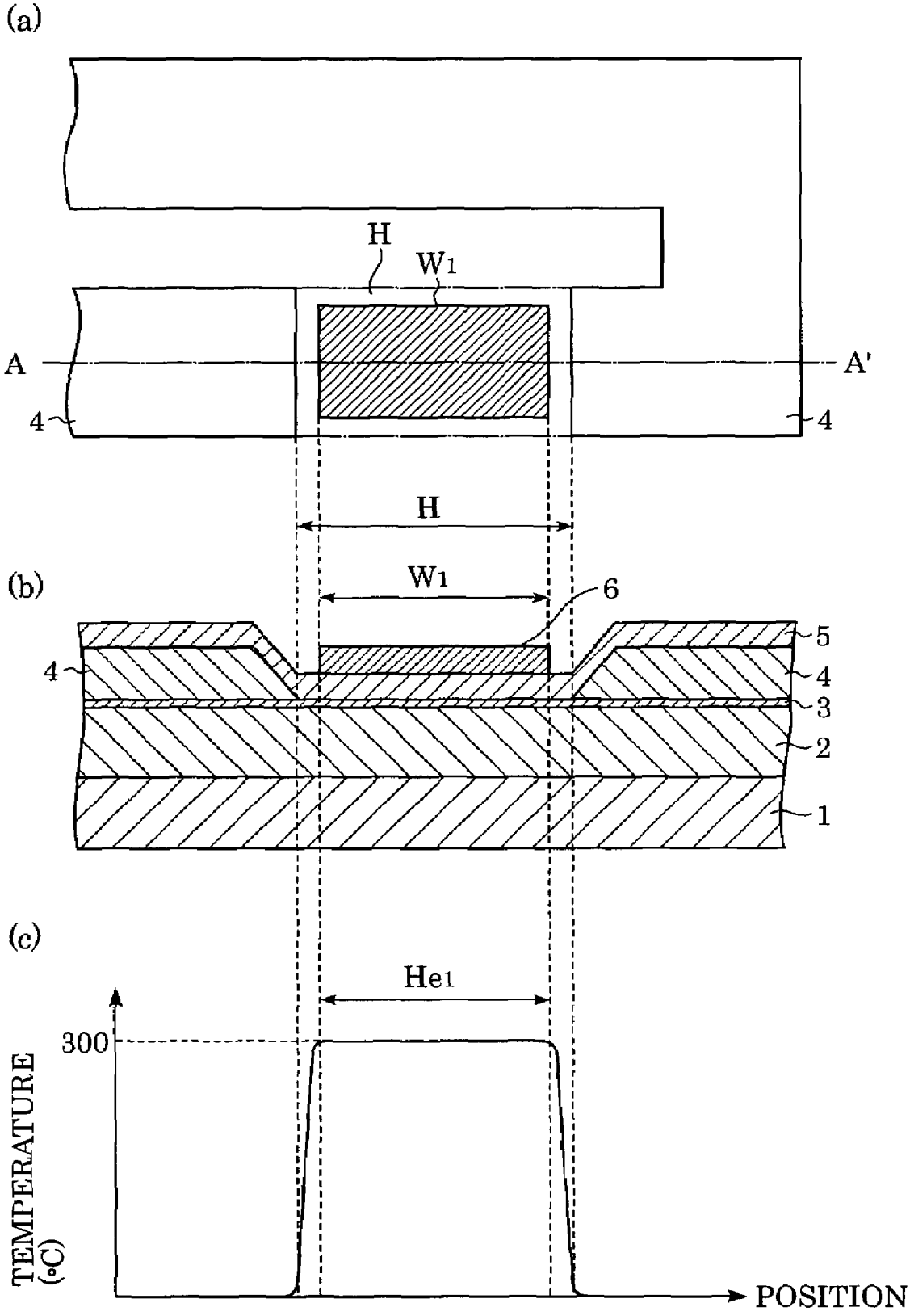
FIG. 3(*a*) is a schematic plan view showing the vicinity of a heater of a liquid discharge head according to a second embodiment of the present invention.

In FIG. 3, the structure of a liquid discharge head of the second embodiment of the present invention and the performance thereof are shown. A schematic plan view of the vicinity of the heater of the liquid discharge head according to this embodiment is shown in FIG. 3(*a*), a partial cross-sectional view of the liquid discharge head shown in FIG. 3(*a*) taken perpendicular to the substrate along the line A-A' is shown in FIG. 3(*b*), and a graph of a temperature distribution along the line A-A' in FIG. 3(*a*) is shown in FIG. 3(*c*), the temperature distribution being obtained when the temperature of the central region of the heater was increased to just below the bubble-forming temperature (approximately 300° C. in an example shown in the figure) by supplying electricity to the heater. In this embodiment, in FIG. 3(*a*), the pattern of the wire 4 is shown through the insulating film 5.

In a method for decreasing impact which is generated in a defoaming step and which is to be applied to a heater, such as a method in which a bubble formed in the liquid is allowed to communicate with the air so as to discharge the liquid, as a metal protective film 6, the area of a protective film region W1 formed of Ir, which is a platinum group element, may be decreased smaller than that of the heat generation region H of the heater as shown in FIG. 3. By the structure described above, the area of the effective bubble-forming region can be increased larger than that formed in the case in which the Ta protective film described above is continuously formed, and in this embodiment, the case described above will be described.

In this embodiment, the protective film region W1 is formed inside the heat generation region H at a distance of about 2 μm apart from the periphery thereof. The rest of the structure of this embodiment is equivalent to that in the first embodiment. It was observed that an effective bubble-forming region He1 of this structure becomes approximately equivalent to the protective film region W1 formed of the metal protective film. As described above, when the metal protective film is formed to have an area approximately equivalent to that of the effective bubble-forming region He1, the area of the effective bubble-forming region can be increased as compared to that obtained by the structure heretofore formed.

In this embodiment, since the effective bubble-forming region is not larger than a region in which the metal protective film is formed, when the size of the region described above is unnecessarily decreased, the effective bubble-forming region is also disadvantageously decreased in size.

As described in the first embodiment, in the structure in which the Ta protective film described above is continuously formed to an adjacent heat generation region, the effective bubble-forming region is located inside the heater at a distance of about 4 μm apart from the periphery thereof. That is, in this embodiment, in order to secure the effective bubble-forming region having an area equal to or more than that heretofore obtained, the area of the protective film may be set in the range from an area inside the heater at a distance of about 4 μm apart from the periphery thereof to an area equal to that of the heat generation region. In order to increase the effective bubble-forming region as compared to that heretofore obtained, the region in which the metal protective film is formed may be located inside the heat generation region of the heater, which is the size of the heater, at a distance of about 1 to 3 μm apart from the periphery thereof.

In addition, the structure may be formed in which a part of the insulating film 5 corresponding to the effective bubble-forming region is decreased, and the metal protective film 6 may be provided for the part described above. In this embodiment, the metal protective film 6 is formed using Ir. However, when a platinum group element such as Pr is used, the same effect as described above can be obtained.

THIRD EMBODIMENT

In the first and the second embodiments described above, the case is described by way of example in which a platinum group element is only used as the metal protective film, and in a third embodiment, the case will be described in which the protective film is formed in combination of a platinum group element and Ta which has been heretofore used. Description of the same elements and structures as those in the second embodiment will be omitted.

Figure 4:
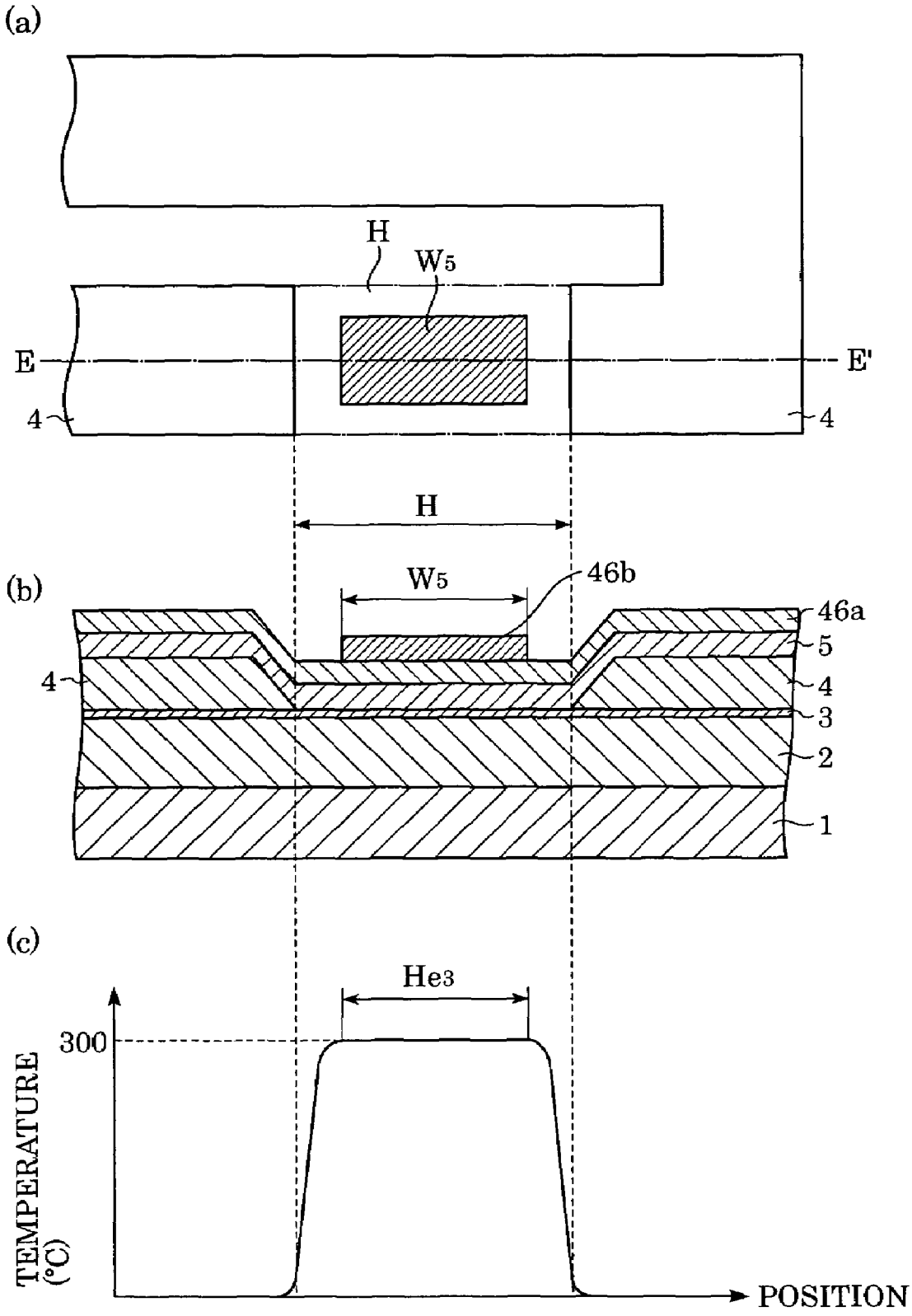
FIG. 4(*a*) is a schematic plan view showing the vicinity of a heater of a liquid discharge head according to a third embodiment of the present invention.

In FIG. 4, the structure of a liquid discharge head of the third embodiment of the present invention and the performance thereof are shown. A schematic plan view of the vicinity of the heater of the liquid discharge head according to this embodiment is shown in FIG. 4(*a*), a schematic cross-sectional view of the liquid discharge head shown in FIG. 4(*a*) taken perpendicular to the substrate along the line E-E' is shown in FIG. 4(*b*), and a graph showing a temperature distribution along the line E-E' in FIG. 4(*a*) is shown in FIG. 4(*c*), the temperature distribution being obtained when the temperature of the central region of the heater was increased to just below the bubble-forming temperature (about 300° C. in the example shown in the figure) by supplying electricity to the heater. In this embodiment, in FIG. 4(*a*), the pattern of wire 4 is shown through the insulating film 5.

In this embodiment, on the insulating film 5, a first protective film 46*a* is formed, and a second protective film 46*b* having a higher thermal conductivity than that of the first protective film 46*a* is formed thereon. For example, the first protective film 46*a* may be formed of a metal such as Ta and the second protective film 46*b* may be formed of a platinum group element such as Pt or Ir.

In this embodiment, the first protective film 46*a* covers the entire heat generation region H of the heater and the wire 4. On the other hand, a second protective film region W5 in which the second protective film 46*b* is formed has an area approximately equivalent to that of an effective bubble-forming region He3 formed when Ta is only used for the protective film. That is, the second protective film region W5 is formed inside the heat generation region at a distance of about 4 μm apart from the periphery thereof. That is, also in this embodiment, in order to secure the effective bubble-forming region equal to or more than that heretofore obtained, the area of the protective film may be set in the range from an area inside the heater at a distance of about 4 μm from the periphery thereof to an area equal to that of the heat generation region. According to the structure of this embodiment, even in a region other than the effective bubble-forming region He3, the first protective film 46*a* is formed on the insulating film 5. Hence, even in a case in which a pin hole is formed in the insulating film 5, liquid such as ink can be prevented from being brought into contact with the wire 4, and as a result, the reliability of the liquid discharge head can be improved.

In addition, when a platinum group element such as Pt or Ir having high chemical stability is used for the second protective film 46*b*, the durability of the heater can be improved as compared to that heretofore obtained. In this case, when the second protective film 46*b* is formed, although the thermal resistance between ink and the heater film 3 is increased to a certain extent, since the thermal conductivity of the second protective film 46*b* is relatively high, and the diffusion of heat is not caused by the second protective film 46*b*, energy efficiency is not considerably decreased. In particular, when the thickness of the second protective film 46*b* is decreased, the thermal resistance can be made substantially equivalent to that obtained when the first protective film 46*a* is only formed, and as a result, energy efficiency equivalent to that heretofore obtained can be achieved. In addition, the structure may be formed in which the thickness of a part of the first protective film 46*a* corresponding to the effective bubble-forming region He3 is decreased, and the second protective film 46*b* may be provided for the part described above. In addition, the structure may also be formed in which the first protective film 46*a* is not formed on a part of the insulating film 5 corresponding to the effective bubble-forming region He3, and the second protective film 46*b* is formed on the part described above so that the second protective film 46*b* is surrounded by the first protective film 46*a*.

Figure 5:
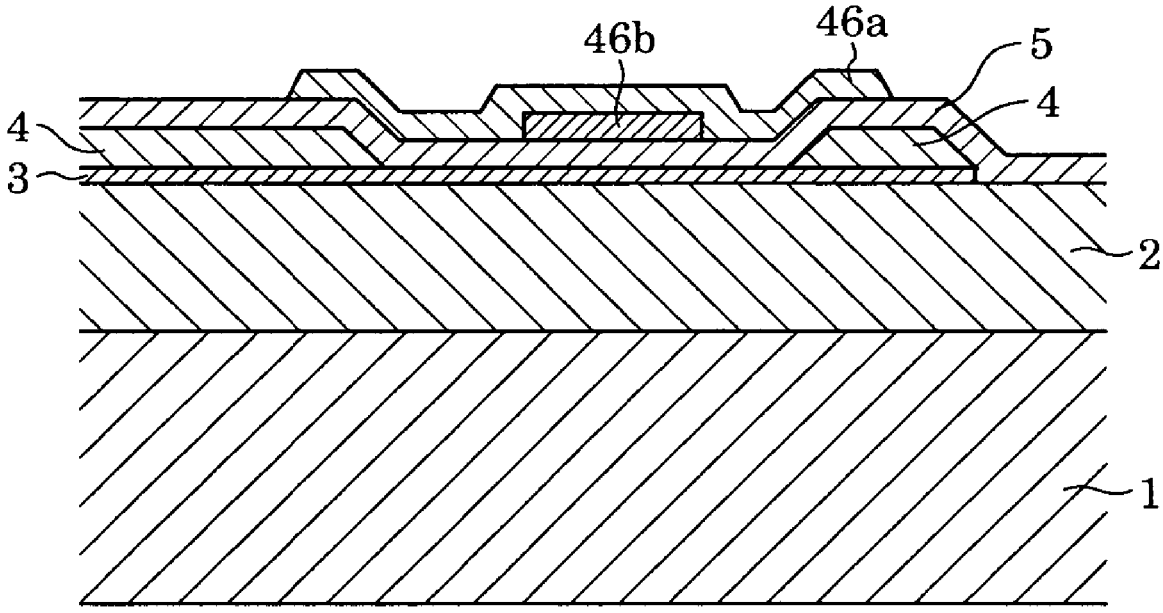
FIG. 5 is a schematic view of the liquid discharge head according to the third embodiment of the present invention.

In addition, as shown in FIG. 5, when the second protective film 46*b* made of a platinum group element such as Ir is formed in a region approximately equivalent to the effective bubble-forming region He3, and the first protective film 46*a* made of a metal such as Ta is formed so as to cover the second protective film 46*b*, an effect equivalent to that described above can be obtained. In this case, although part of the Ta protective film 46*a* provided in the heat generation region is gradually eroded by cavitation, this erosion is stopped in the vicinity of the interface with the protective film made of a platinum group element such as Pt or Ir, and hence any problem may not arise.

In addition, an adhesion layer may be formed between the first metal protective film 46*a* and the second metal protective film 46*b*, and by the structure described above, the adhesion therebetween can be improved. As a material for this adhesion layer, for example, Ti may be mentioned.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application Nos. 2004-086867 filed Mar. 24, 2004 and 2005-026423 filed Feb. 2, 2005, which are hereby incorporated by reference herein.

What is claimed is:

1. A liquid discharge head substrate comprising:

a substrate;

a plurality of heating elements provided on the substrate, the heating elements operable to generate thermal energy so as to discharge a liquid; and metal protective films separately provided for the respective heating elements to protect the heating elements, wherein the metal protective films include a platinum group element, and wherein the periphery of each of the metal protective films is located in a region from a line inside each of the heating elements at a distance of 4 μm apart from the periphery thereof to a line outside each of the heating elements at a distance of 0.5 μm apart from the periphery thereof.

2. The liquid discharge head substrate according to claim 1, further comprising a first protective film provided for the heating element, the first protective film having a thermal conductivity substantially lower than a thermal conductivity of the metal protective films.

3. The liquid discharge head substrate according to claim 2, wherein the first protective film is formed between the substrate and the metal protective films.

4. The liquid discharge head substrate according to claim 2, wherein the metal protective films are formed between the first protective film and the substrate such that the first protective film covers the metal protective films.

5. The liquid discharge head substrate according to claim 2, wherein the first protective film include tantalum (Ta).

6. A liquid discharge head comprising:

the liquid discharge head substrate according to claim 1; and a flow path member provided on the liquid discharge head substrate and including flow paths and discharge ports communicating with the flow paths, the flow paths being provided for the respective heating elements.

7. A liquid discharge head comprising:

a liquid discharge head substrate including:

a substrate;

a plurality of heating elements provided on the substrate, the heating elements operable to generate thermal energy so as to discharge a liquid; and metal protective films separately provided for the respective heating elements to protect the heating elements, wherein the metal protective films include a platinum group element;

a flow path member provided on the liquid discharge head substrate and including flow paths and discharge ports communicating with the flow paths, the flow paths being provided for the respective heating elements; and an adhesion layer adhering the flow path member to the liquid discharge head substrate, the adhesion layer being provided between the flow path member and the liquid discharge head substrate and between the metal protective films, wherein the adhesion layer partly overlaps with end portions of the metal protective films.

8. The liquid discharge head according to claim 7, wherein the periphery of each of the metal protective films is located in a region from a line inside each of the heating elements at a distance of 4 μm apart from the periphery thereof to a line outside each of the heating elements at a distance of 0.5 μm apart from the periphery thereof.

9. The liquid discharge head according to claim 7, further comprising a first protective film provided for the heating element, the first protective film having a thermal conductivity substantially lower than a thermal conductivity of the metal protective films.

10. The liquid discharge head according to claim 9, wherein the first protective film is formed between the substrate and the metal protective films.

11. The liquid discharge head according to claim 9, wherein the metal protective films are formed between the first protective film and the substrate such that the first protective film covers the metal protective films.

12. The liquid discharge head according to claim 9, wherein the first protective film include tantalum (Ta).

* * * * *